US005270951A

United States Patent [19]

Deters et al.

[11] Patent Number: 5,270,951

[45] Date of Patent: Dec. 14, 1993

[54] METHOD AND APPARATUS FOR STORING ERROR SIGNALS

[75] Inventors: Ludger Deters, Remscheid; Manfred Müller, Wuppertal; Bernd Neumann, Radevormwald; Manfred Stüttem, Kürten, all of Fed. Rep. of Germany

[73] Assignee: Barmag AG, Remscheid, Fed. Rep. of Germany

[21] Appl. No.: 703,374

[22] Filed: May 21, 1991

[30] Foreign Application Priority Data

May 22, 1990 [DE] Fed. Rep. of Germany ..... 4016470
Aug. 28, 1990 [DE] Fed. Rep. of Germany ..... 4027132

[51] Int. Cl.[5] ..... G01B 7/18
[52] U.S. Cl. ..... 364/551.01; 340/677
[58] Field of Search ..... 340/677, 522; 364/470, 364/550, 551.01

[56] References Cited

U.S. PATENT DOCUMENTS 4,656,465 4/1987 Erni et al. ..... 340/677
4,677,860 4/1987 Wessolowski et al. .
4,720,702 1/1988 Martens .
4,720,806 1/1988 Schippers et al. .
4,881,062 11/1989 Makino et al. ..... 340/677
4,888,944 12/1989 Felix ..... 340/677
4,951,030 8/1990 Jones et al. ..... 340/677

FOREIGN PATENT DOCUMENTS 3249864 8/1984 Fed. Rep. of Germany .
3601161 1/1986 Fed. Rep. of Germany .
3607959 3/1986 Fed. Rep. of Germany .

*Primary Examiner*—Jack B. Harvey
*Assistant Examiner*—Thomas Peeso
*Attorney, Agent, or Firm*—Bell, Seltzer, Park & Gibson

[57] ABSTRACT

A method of storing in a memory having a predetermined number of storage spaces signals representative of deviations in the tension continuously monitored in a plurality of strands of yarn running in a textile machine. The signals from the individual strands are sequentially fed into a memory and are initially stored in the available spaces. Once the memory is filled, the highest number of earlier stored signals is reduced by later signals being written over them.

5 Claims, 4 Drawing Sheets

METHOD AND APPARATUS FOR STORING ERROR SIGNALS

FIELD OF THE INVENTION

The invention in general relates to a novel method and apparatus for storing signals and, more particularly, to a method and apparatus for allocating space in a memory of otherwise insufficient capacity to signals such as, for instance, error signals derived from a plurality of sources such as, for instance, thread tension monitors of textile machines.

BACKGROUND OF THE INVENTION

It is conventional to monitor automatic industrial production processes. For instance, in synthetic yarn false twisting machines in which endless threads are subjected to a false twisting operation for the purpose of imparting to them characteristics similar to the irregular structure of natural fibres, it is necessary and conducive to obtaining desirable results, in performing the false twisting operation that the thread or yarn move at a tension maintained within a predetermined range. Yarn tension above or below the predetermined range will likely result in a useless product. Hence, the tension of a moving yarn is routinely monitored for purposes of controlling and, in case of undesirable deviations, adjusting the operation of the machine. U.S. Pat. No 4 720,702 issued Jan. 19, 1988 to Gerhard Martens and assigned to the present assignee discloses a method and apparatus for monitoring the tension of a moving yarn which in case of an error signal of predetermined duration provides for the generation of visual or audible alarms and for the cutting of the yarn. An error signal is generated, whenever the tension goes beyond an upper or lower limit. The disclosure of U.S. Pat. No. 4,720 702 is expressly incorporated herein by reference.

Modern textile machines, including synthetic yarn false twisting machines, as a rule are provided with a great many operating positions, sometimes as many as 216, divided into 18 work stations of 12 positions each. Each of these positions may be provided with a heater for raising the temperature of the yarn before it enters the false twisting apparatus and with appropriate feed rolls for moving the thread at a predetermined tension from a supply thereof to a bobbin. In addition, each working position may be provided with an electromechanically actuated facility for cutting the thread in response to a signal indicating that thread tension is outside of a desired range. The electromechanical cutting fixture may be controlled by circuitry deriving readings of the tension of each thread by way of sensors.

Providing separate control circuits and memories for each one of the working positions would, of course, be unduly complex, and the expense would be prohibitive.

It is, therefore, an object of the present invention to provide for a method and apparatus for monitoring the tension of a plurality of threads moving in as many working positions and for storing error signals in a memory of limited capacity for the purpose of analyzing the cause of any incorrect tension and/or of controlling the operation of the working position as a function of thread tension.

It is a more general object of the invention to provide a method of storing a plurality of error signals generated by a plurality of sources in orderly fashion in a memory of limited capacity.

Yet another object of the invention is to provide a method of storing in a memory error signals from a plurality of sources in which earlier error signals may be eliminated in favour of later derived signals.

Still another object of the invention is to provide for a method of storing, in orderly fashion, error signals from a plurality of working stations of a synthetic yarn false twisting machine, in memory space ordinarily insufficient for the number of signals.

It is also an object of the invention to provide a method of storing error signals in such a way that signals derived from one working position may at least in part override earlier stored error signals from another working position.

SUMMARY OF THE INVENTION

These and other objects and advantages of the present invention are achieved in the embodiments herein illustrated by the provision of a method and apparatus comprising a memory in which the signals which have been stored earliest and which have the highest number are written over by later derived signals. In the preferred embodiment, the method and apparatus include the steps of continuously monitoring the value of the tension of the advancing yarn at each of the yarn processing positions, generating an alarm signal whenever the monitored tension for one of the advancing yarns leaves a predetermined tolerance range, and storing the generated alarm signals in a memory having a predetermined number of storage spaces and comprising (a) storing the alarm signals from the positions in sequence until the predetermined number of storage spaces are fully utilized, and then (b) storing subsequent alarm signals from the positions in a continued sequence by eliminating the initially stored signals of the positions having the highest number of stored signals by writing over the stored signals.

BRIEF DESCRIPTION OF THE DRAWINGS

Some of the objects and advantages have been stated, others will become apparent as the description proceeds, when taking in conjunction with the accompanying drawings, in which.

DETAILED DESCRIPTION OF THE PREFERRED EMBODIMENT

Figure 1:
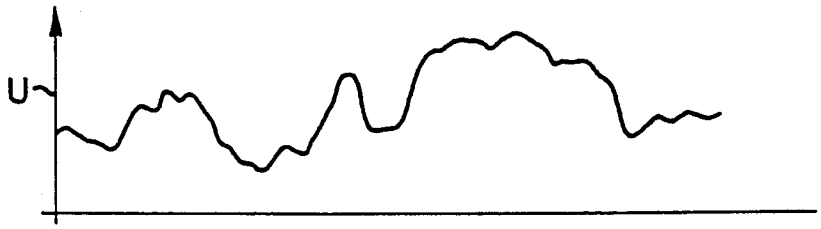
FIG. 1 is a diagram illustrating a segment of a graph of yarn tension versus time, with the yarn tension being indicated by an output signal U from a tension sensor.
Figure 2:
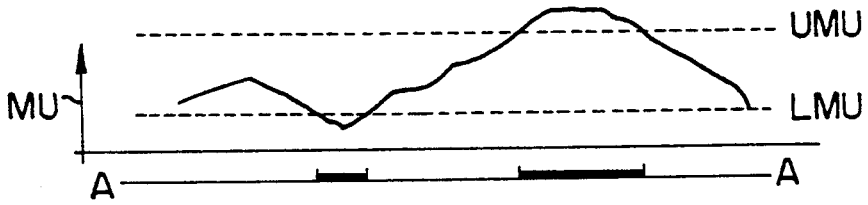
FIG. 2 is a similar view illustrating the mean value MU derived from a continuous reading of the yarn tension U in FIG. 1.
Figure 3:
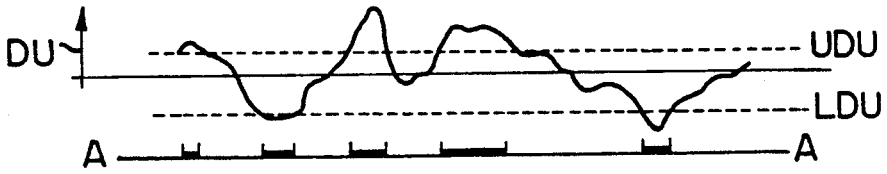
FIG. 3 is a diagram illustrating the difference value DU representative of the difference between the actual value U and the mean value MU.

Having regard to FIGS. 1 to 3, the signals of interest in connection with the present invention have been graphically depicted. Thus, the continuously measured actual tension of the thread as converted into a voltage signal U is depicted in FIG. 1. It is used to derive a mean value of the tension MU as depicted in FIG. 2. The broken lines UMU and LMU shown in FIG. 2 represent empirically determined upper and lower limits of a range of mean or average values MU acceptable for flawless operating conditions. As shown by thick line sections on line A of FIG. 2, the mean value MU is at two instances outside, i.e. below or above, the predetermined lower and upper limits of the range. These thick line sections represent error signals in the sense of the present invention and indicate momentary occurrences of unacceptable, i.e. faulty, thread tension. FIG. 3 depicts the difference DU between the measured instantaneous thread tension and the mean or average thread tension MU. Wherever the difference exceeds or falls below upper and lower limits UDU and LDU, respectively, of the difference value, an error signal is generated as depicted by the thick line sections of line A of FIG. 3. These upper and lower excesses of the difference also generate error signals of interest in connection with the instant invention.

Figure 4:
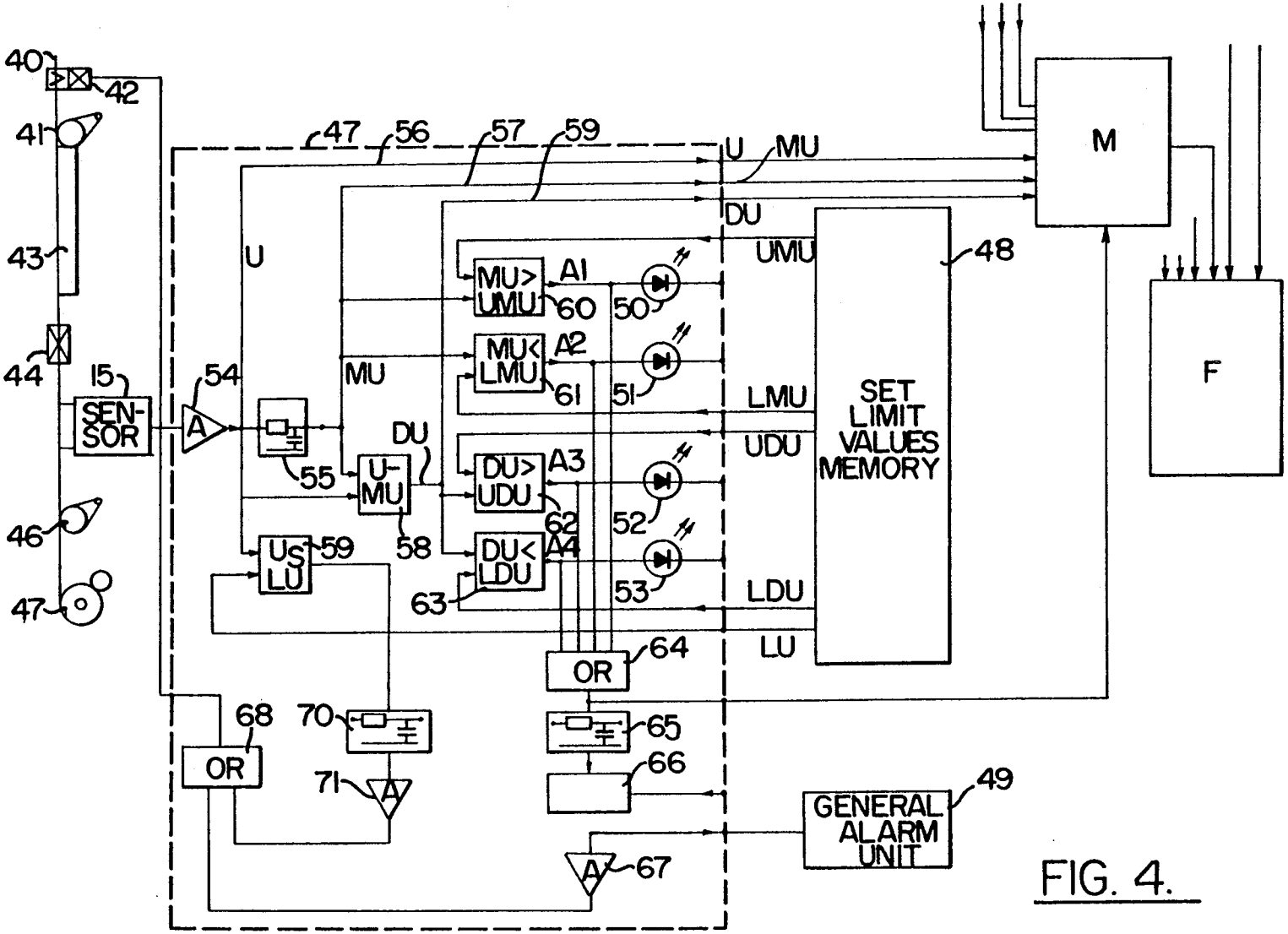
FIGS. 4, 4*a*, and 4*b* are diagrams of alternative circuits schematically illustrating the function of and controls for apparatus useful for performing the method in accordance with the invention.

As schematically indicated in FIG. 4 of the drawings a thread or yarn 40 may be moved from a supply thereof (not shown) by means of feed rollers 41 and 46 to a wind-up bobbin 47. Ahead of the feed roller 41, in the direction of yarn travel, there may be provided a cutting mechanism 42 which may be selectively actuated in a manner to be described, for cutting the yarn 40. Following the feed roll 41, there is a heater 43 for heating the yarn to a temperature appropriate for a false twisting operation by a false twisting mechanism 44 in a conventional manner. Following the false twisting mechanism 44 there is provided a sensor 15, the purpose of which is to continually monitor the tension of the yarn 40 and to generate signals for further processing in a manner to be described. Once the yarn has passed the sensor 15, it is engaged by the other feed roller 46 before it is at last wound up on the bobbin 47. The bobbin 47 may, as is customary, be driven by a friction roller and may be associated with a traversing mechanism (not shown) for properly winding the yarn.

The signals generated by the sensor 15 may be voltage signals, for instance, and may be fed to a control circuit 47 by way of a conventional amplifier 54.

The output of the amplifier 54 is represented by U and may be a function of the tension of the yarn 40. It may be applied to a processing unit (not shown) and to a central or collective signal storage memory M. The signals U are also applied to a time delay stage 55 having a constant of from 1 to 3 seconds. The time delay stage 55 comprises an RC circuit including a capacitor and a resistor. The time delay stage 55 constitutes a filter for filtering out spurious signals such as voltage surges or spikes and serves to generate mean values MU of the instantaneous signals U. The time constant of the filter 55 determines the quality of the derived mean value. That is to say, increasing the time constant reduces the effect of short term voltage fluctuations on the mean value MU and vice versa. Furthermore, the signal U is applied to one input of a subtractor 58 and to one input of a comparator or trigger 69.

As illustrated, the mean value signal MU is fed to the central processing unit (not shown) for further processing. It is also supplied to the other input of the subtractor 58. In the subtractor, the mean value MU is subtracted from the instantaneous tension value U to yield a difference signal DU. The mean value MU is also applied to one input of each of two comparators or triggers 60 and 61.

The output DU of the subtractor 58 is applied to the central processing unit (not shown) for further processing, and it is applied to one of two inputs of comparators or triggers 62 and 63. It is to be noted that all of the comparators or triggers as well as the subtractor are entirely conventional, and their construction and function are well known in the art. The comparator 69 as well as the comparators 60, 61, 62, and 63 may be Schmitt triggers which may provide an output signal in response to an input of predetermined magnitude.

The instantaneous value U, the mean value MU and the difference value DU are compared against reference values. The reference values may be set empirically or may be stored in a set limit values memory 48 which preferably is a read only memory (ROM). Thus, an output signal LU from the memory 48 is applied to the other input of the comparator 69. The signal LU represents the lowest yarn tension and may be set as low as zero. The signal LU is compared against the instantaneous value U. The trigger 69, for instance, releases a signal whenever the signal U is equal to or lower than the low tension value signal LU. The output signal of the trigger 69 is applied to another time delay circuit or filter 70 having a time constant of, for instance, 10 ms. The time delay is introduced to suppress spurious signals. The output of the time delay circuit 70 is applied to an amplifier 71, the output of which is in turn applied to one of two inputs of an OR gate 68. The output of the OR gate 68 is applied to the electromagnetically actuated cutting device 42 for cutting the yarn 40 whenever its measured tension is equal to or less than the value LU.

The memory 48 also contains values representing upper and lower limits of the mean value MU. Signals representing these upper and lower limits, UMU and LMU are, respectively, fed to the other input of triggers 60 and 61. Every time the mean value MU exceeds its upper limit UMU a signal Al appears at the output of the trigger 60 and activates a visual alarm such as a light emitting diode (LED) 50. On the other hand, if the mean value MU is lower than the lower limit LMU, a signal A2 will appear at the output of trigger 61 to activate another LED 51. It will be seen that the signals A1 and A2 are also fed to an OR gate 64, the function of which will be explained hereinafter.

The set limit values memory 48 also determines upper and lower limits of the difference signal DU which are tolerable for proper machine operation. Values UDU and LDU representing, respectively, the upper and lower difference signal values are, respectively, applied to comparators 62 and 63. These limit values are compared against the actual difference signal DU, so that whenever DU is greater than UDU the comparator or trigger 62 releases the signal A3 which, in turn, activates a light emitting diode (LED) 52. In case the lower limit LDU is higher than the actual difference value DU, the trigger 63 releases an output signal A4 which causes a light emitting diode (LED) 53 to be illuminated. The signals A3 and A4 are also fed to the OR gate 64. From the OR gate 64 anyone of the signals A1, A2, A3, or A4 may be fed to the collective memory M. The output of the OR gate 64 is also connected to the input of a filter or time delay circuit 65 having a time delay constant of preferably 10 ms. The purpose of the time delay circuit 65 is to suppress spurious signals. Once, a signal A1, A2, A3, or A4 passes the time delay circuit 65 it is applied to a memory 66 which ensures that a general alarm unit 49, for instance an audible alarm which is associated with a group of work stations or with the entire machine is activated to give off a signal indicating that something has gone awry with the operation of the machine. The output of the memory 66 is also applied to the OR gate 68 so that, as will be apparent to those skilled in the art, any one of the signals A1, A2, A3, or A4 may cause actuation of the electromechanically controlled cutting device 42.

Figure 4A:
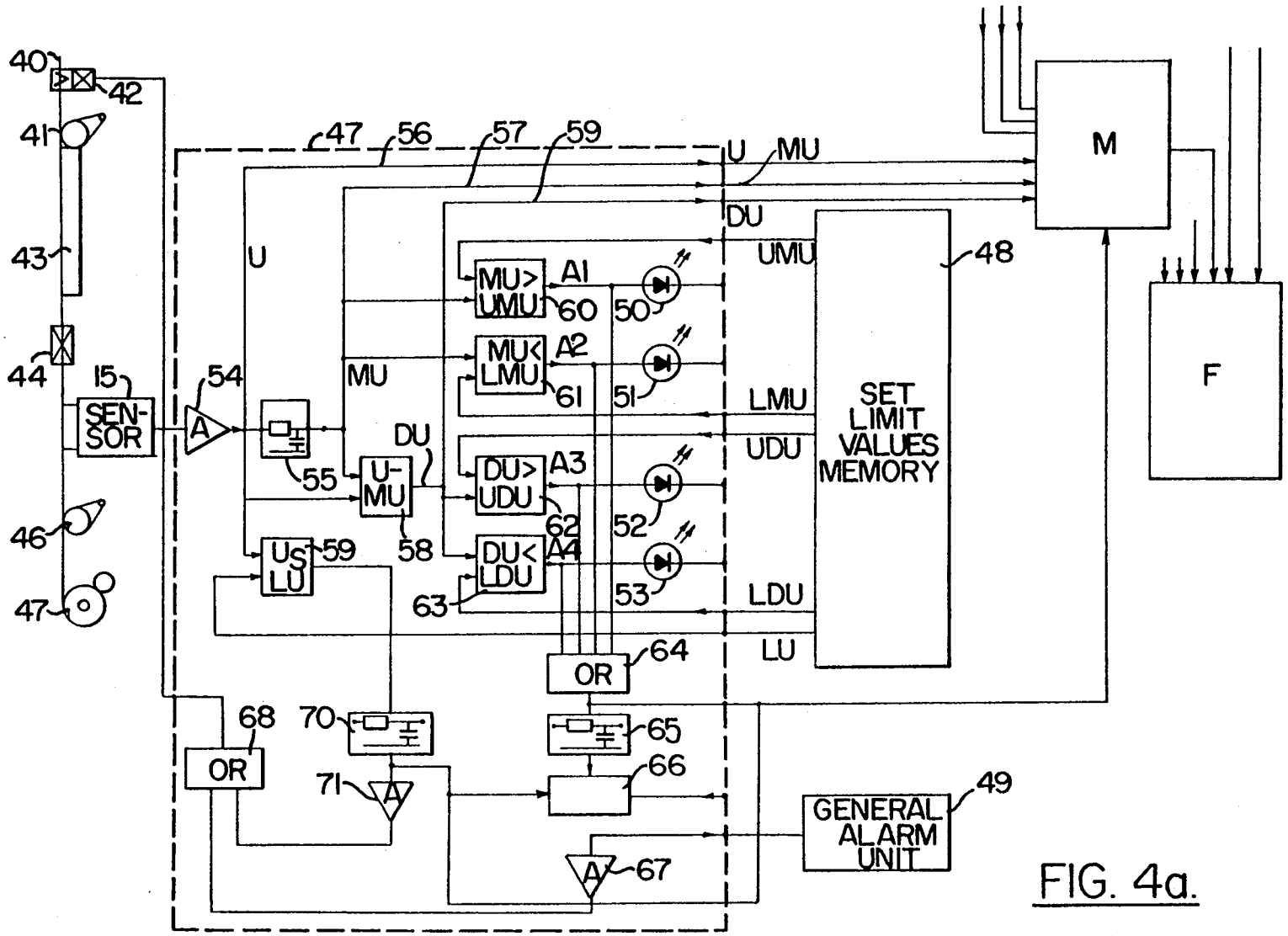
Figure 4B:
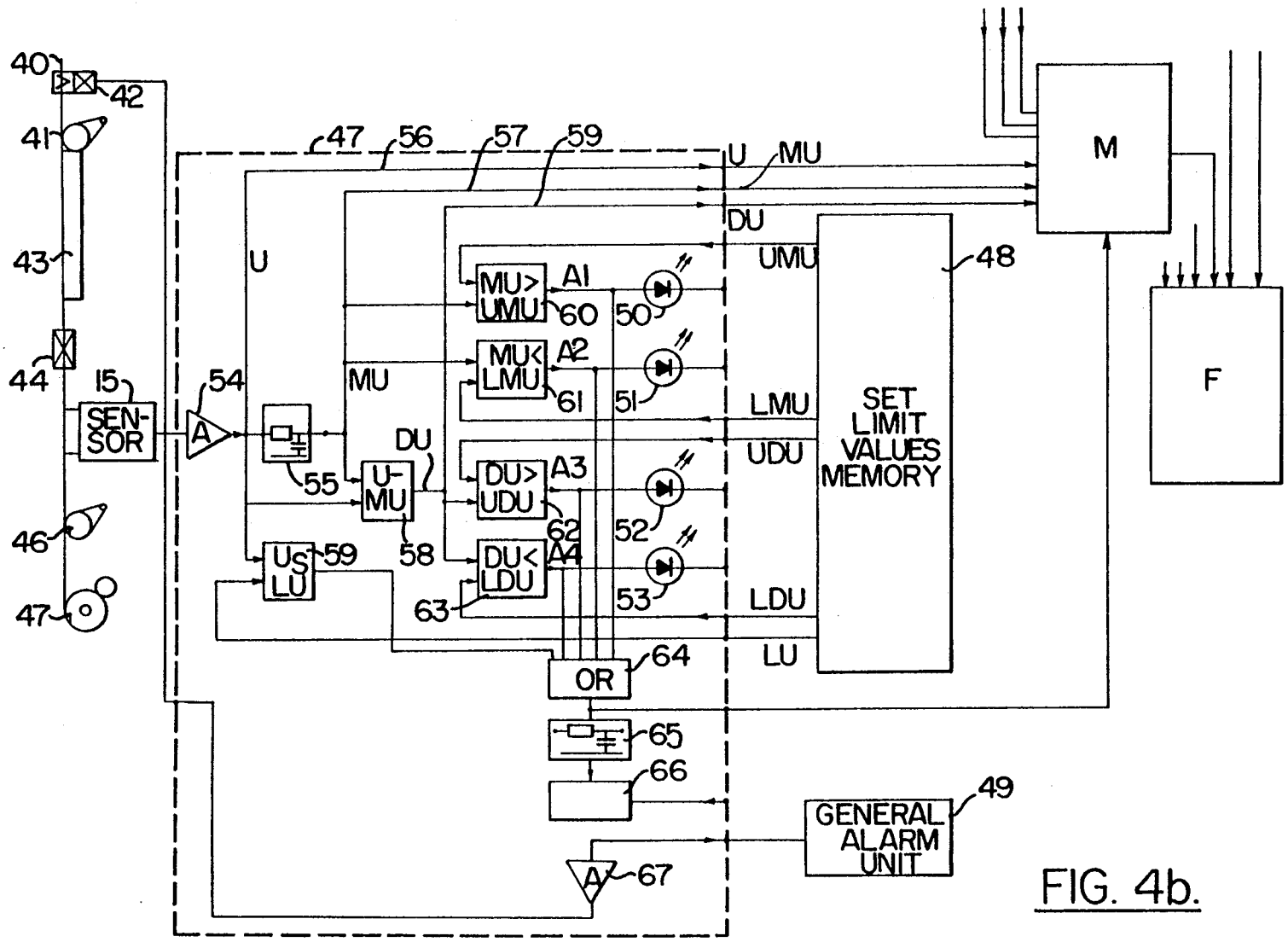

Alternative arrangements have been shown in FIGS. 4A and 4B. In the former, an output signal released from the trigger 69 and passed through the time delay circuit 70 is also applied to the memory 66 so that it may cause release of the audible alarm 49 and it is fed to the collective memory M. In the embodiment of FIG. 4B the output of the trigger 69 is directly connected to the OR gate 64 so that its function is substantially similar to that of error signals A1, A2, A3, or A4.

As indicated in FIG. 4 the actual tension signal U derived from the sensor 15 and the amplifier 54 is fed to the collective memory M. Also fed into the memory are the mean value MU derived from the filter 55 and the difference signal DU generated at the output of the subtractor 58.

In accordance with the invention the oldest recorded signals are continually written over or replaced by later signals. Two kinds of errors are detected: These are, firstly, errors in the mean value occurring whenever the continuously monitored mean value MU exceeds or drops below upper and lower limits UMU and LMU of the predetermined range and, secondly, errors in the difference signal generated whenever the continuously monitored difference value DU is in excess of or below upper and lower maximum values UDU and LDU of the predetermined range.

Whenever a signal A1, A2 or A3, A4 indicative of an error in the mean tension value or in the difference value is generated, the output signal of the OR gate 64 is applied to the collective memory M. This causes the release to memory F of a sequence of queue of measured values U, MU, or DU, as the case may be, which goes back before the occurrence of the error signal and which preferably lasts until after the error signal has disappeared. The duration or length of this sequence or queue is a function of the storage space reserved for the error signal record in the error signal memory or storage F. The collective memory M and the error signal memory F are connected to the circuit and to each other as shown in FIGS. 4, 4A, and 4B.

Filling the memory is accomplished in the following manner: The false twisting machine may have as many as 18 longitudinally arranged operating stations, each station being divided into 12 positions. To cover the machine, a certain number of storage spaces, for instance 1080, may be reserved in the error signal memory F. Therefore, each station will have 60 storage spaces, and each position will have allotted 5 storage spaces.

The following events are assumed to occur:

1. A large number of errors occur at the first operating position. However, for each measuring position there is a maximum storage capacity for 1080 error signal records. Accordingly, at position 1 there are stored 1080 records of errors.

2. 300 errors occur at measuring position 2. Therefore at position 1 780 errors are stored and at position 2 300 errors are stored.

3. An additional 350 errors occur at measuring position 3. The storage of the errors is thus accomplished as follows:

| | |
|---|---|
| Position 1 | 430 errors |
| Position 2 | 300 errors |
| Position 3 | 350 errors |

4. An additional 100 errors are generated at measuring position 4. Therefore,

| |
|---|
| Position 1 stores 340 errors |
| Position 2 stores 300 errors |
| Position 3 stores 340 errors |
| Position 4 stores 100 errors. |

5. Another 300 errors are generated at position 5. Therefore,

| |
|---|
| Position 1 stores 245 errors |
| Position 2 stores 245 errors |
| Position 3 stores 245 errors |
| Position 4 stores 100 errors, and |
| Position 5 stores 245 errors. |

From the above it will be seen that the storage space for those positions having the highest number of errors was redistributed to several positions, that is to say that older records with the highest number of stored errors were written over by later error signals.

To the extent it is necessary to store errors from further positions the required storage space will be provided by canceling errors from those earlier records at which the greatest number of errors have been recorded. If each position generates a number of errors in excess of five, five error signals will, nevertheless, be stored for each of those positions.

The invention, in the manner described above, thus provides for an effective method of accommodating error signals from a plurality of sources, in a memory of limited capacity.

That which is claimed is:

1. A method of monitoring the tension of a strand of advancing yarn at each of a plurality of monitored yarn processing positions of a yarn processing machine and comprising the steps of continuously monitoring the value of the tension of the advancing strand at each of the yarn processing positions, while continuously determining the mean value of the monitored tension of each of the strands, and while also continuously determining the differential between the monitored value and the mean value for each of the strands, generating an alarm signal whenever the mean value for one of the advancing strands leaves a predetermined tolerance range, or whenever the differential value for one of the advancing strands leaves a second predetermined tolerance range, and storing the generated alarm signals in a memory having a predetermined number of storage spaces and comprising (a) storing the alarm signals from the positions in sequence until the predetermined number of storage spaces are fully utilized, and then (b) storing subsequent alarm signals from the positions in a continued sequence by eliminating the initially stored signals of the positions having the highest number of stored signals by writing over the stored signals.

2. An apparatus for monitoring the tension of a strand of advancing yarn at each of a plurality of monitored yarn processing positions of a yarn processing machine comprising sensor means for continuously monitoring the value of the tension of the advancing strand at each of the yarn processing positions and for producing a continuous output signal representative of the value of the tension of each strand, means for generating an alarm signal whenever the tension for one of the advancing strands leaves a predetermined tolerance range, a memory having a predetermined number of storage spaces which at least equal the number of the yarn processing positions, means for initially filling the storage spaces with first alarm signals received from at least one of said yarn processing positions, and means for subsequently storing a predetermined number of alarm signals received from at least another of said plurality of yarn processing positions and so as to eliminate an equal number of said first alarm signals from said storage spaces by writing over the initially stored signals of the positions having the highest number of stored signals.

3. The apparatus as defined in claim 2 further comprising circuit means operatively connected to the sensor means for continuously determining the mean value of the monitored tension of each of the strands, and for also continuously determining the differential between the monitored value and the mean value for each of the strands, and wherein said means for generating an alarm signal includes means for generating an alarm signal whenever the mean value for one of the advancing strands leaves a predetermined tolerance range, or whenever the differential value for one of the advancing strands leaves a second predetermined tolerance range.

4. A method of monitoring the tension of a strand of advancing yarn at each of a plurality of monitored yarn processing positions of a yarn processing machine, comprising the steps of continuously storing signals representing the values of the monitored tension at each position in a collective memory;

for each position at which an error occurs with respect to the respective monitored tension value, moving a sequence of signals representing the value of monitored tension as monitored at or contiguous with the time of said error from said collective memory to an error memory such that said sequence of signals is associated with said position; and upon said error memory being filled to a predetermined number of storage spaces, eliminating the initially stored signals only of those positions, the signals of which occupy the largest number of storage spaces.

5. A method of monitoring the tension of a strand of advancing yarn at each of a plurality of monitored yarn processing positions of a yarn processing machine, comprising the steps of at each position at which an error occurs with respect to the respective monitored tension value, storing a sequence of signals representing the value of the tension as monitored at or contiguous with the time of said error to an error memory and such that said sequence of signals is associated with said position; and upon said error memory being filled to a predetermined number of storage spaces, eliminating the initially stored signals only of those positions the signals of which occupy the largest number of storage spaces.

* * * * *